US011926938B2

(12) United States Patent
Zafiroglu et al.

(10) Patent No.: US 11,926,938 B2
(45) Date of Patent: Mar. 12, 2024

(54) ABSORBENT STITCHBONDED FABRICS AND DIMENSIONALLY SET STITCHBONDED FABRICS

(71) Applicant: Xymid, LLC., Midlothian, VA (US)

(72) Inventors: Dimitri Zafiroglu, Centreville, DE (US); Jason Billups, Northern Chesterfield, VA (US)

(73) Assignee: Xymid, LLC., Midlothian, VA (US)

( * ) Notice: Subject to any disclaimer, the term of this patent is extended or adjusted under 35 U.S.C. 154(b) by 321 days.

(21) Appl. No.: 17/104,847

(22) Filed: Nov. 25, 2020

(65) Prior Publication Data

US 2021/0156059 A1 May 27, 2021

Related U.S. Application Data

(60) Provisional application No. 62/939,896, filed on Nov. 25, 2019.

(51) Int. Cl.

| | |
|---|---|
| ***D04B 21/16*** | (2006.01) |
| ***B32B 5/06*** | (2006.01) |
| ***B32B 5/26*** | (2006.01) |
| ***D04H 3/005*** | (2012.01) |
| ***D04H 3/02*** | (2006.01) |
| ***D04H 3/08*** | (2006.01) |
| ***D04H 3/147*** | (2012.01) |

(52) U.S. Cl.

CPC ..... *D04B 21/165* (2013.01); *D04H 3/005* (2013.01); *D04H 3/02* (2013.01); *D04H 3/147* (2013.01); *D10B 2401/02* (2013.01); *D10B 2403/02* (2013.01); *D10B 2509/026* (2013.01)

(58) Field of Classification Search

CPC ..... D04B 21/165; D10B 2509/026; D04H 3/005; A61F 2013/15406; B32B 5/06; B32B 5/266

See application file for complete search history.

(56) References Cited

U.S. PATENT DOCUMENTS 5,623,888 A * 4/1997 Zafiroglu ..... D04B 21/165 428/152
6,593,256 B1 * 7/2003 Wildeman ..... D04H 1/43835 442/389

(Continued)

*Primary Examiner* — Joanna Pleszczynska

(74) *Attorney, Agent, or Firm* — The H. T. Than Law Group

(57) ABSTRACT

Disclosed herein a stitch-bonded fabric comprising at least one fibrous web layer having a plurality of the fibers with a first length of more than about 25 mm, oriented substantially in a cross-direction (XD) of the stitch-bonded fabric wherein a density of the at least one fibrous web layer is less than about 0.12 g/cm$^3$. The at least one fibrous web layer is stitch-bonded with yarns following a pattern of linear stitches along a machine direction (MD) spaced from about 1.4 mm to about 4.0 mm along XD, and repeating with a spacing front about 0.8 mm to about 2.5 mm in MD, wherein the plurality of fibers having said first length are captured by multiple stitches. A density of fibers and yarn enclosed within the stitches is above about 0.10 g/cm$^3$ and below about 5.0 g/cm$^3$ and the linear stiches are depressed below exposed the wales between the linear stitches along MD. The stitch-bonded yarns can be heat set to stabilize the stitch-bonded fabric.

21 Claims, 5 Drawing Sheets

(56) References Cited

U.S. PATENT DOCUMENTS

| | | | | |
|---|---|---|---|---|
| 7,141,290 | B2 * | 11/2006 | Tsiarkezos | D04H 1/66 428/95 |
| 2003/0070739 | A1 * | 4/2003 | Zafiroglu | D04B 21/02 156/93 |
| 2009/0280710 | A1 * | 11/2009 | Zafiroglu | B32B 7/027 442/405 |
| 2014/0343526 | A1 * | 11/2014 | Knapmeyer | D04H 1/43828 428/196 |
| 2015/0359687 | A1 * | 12/2015 | Goda | A61F 13/539 156/60 |

* cited by examiner

ABSORBENT STITCHBONDED FABRICS AND DIMENSIONALLY SET STITCHBONDED FABRICS

FIELD OF THE INVENTION

The present invention relates to reusable, washable, durable, absorbent or non-absorbent stitch-bonded nonwoven fabrics and to stitch-bonded nonwoven fabrics that have their dimensions set. Such fabrics can be used as absorbent pads, such as those for absorbing cooking meat fats; non-disposable diapers; sanitary products; protective bed pads; reusable towels; paint drip cloths and as coverings for floors and walls.

BACKGROUND OF THE INVENTION

Disposable absorbent products are convenient for consumers. However, the costs for disposing disposable products after a single use for the environment are immeasurably high. In one example, one baby would go through about 7,500 diapers of various sizes before becoming toilet trained. Many of these disposable products contain plastics that don't readily breakdown and that require the production of hydrocarbons. All of these spent products end up in landfills and require many years to decompose. Plastic-free products, such as papers and wood pulps, decompose in less time but require the destruction of natural resources.

Conventional reusable products do not completely satisfy consumers' needs. Reusable diapers are typically made from cloths and do not hold baby waste products well. Water-resistant diapers are uncomfortable and are not widely available. Canvas paint drop cloths are expensive, heavy and thick, and too cumbersome to wash even in commercial washers. Disposable paint drop-cloths tear easily under foot traffic, lack the durability to be reused and cannot be washed. Washable kitchen towels stain easily and after a few washes can no longer lay flat and have wavy ridges formed on their edges.

For flat surface covering end uses, the inability to lay flat is related to the lack of dimensional stability of stitchbonded fabrics. The appearance and performance of the stitch-bonded fabrics would be improved with dimensional or planar stability of both absorbent and non-absorbent fabrics.

Hence, there remains a need for reusable, washable and durable stitchbonded fabrics and stitchbonded fabrics that are more dimensionally or planarly stable.

SUMMARY OF THE INVENTION

One embodiment of the present invention is directed to absorbent fibrous fabrics comprising a bulky, absorbent fibrous web that is stitch-bonded linearly in the machine direction (MD) with shrinkable yarns. The fibrous web preferably comprises a plurality of long staple fibers or continuous filaments that orientated substantially in the cross direction (XD), i.e., these staple fibers or filaments are orientated on the fibrous web, such that the XD orthogonal component of the staple fibers or filaments is about the same as or greater than MD orthogonal component of these staple fibers or filaments are orientated at about 45' or less from XD. The stabilized fibers or filaments are preferably caught and held by a plurality of stitches or stitch points, and are retained therein when preferably the stitching yarns are shrunk. Optionally, the fibrous web also gathers substantially in MD. As used herein, MD and XD are substantially orthogonal from each other.

Another embodiment of the present invention is directed to fibrous fabrics comprising a fibrous web that is stitch bonded linearly in MD with a heat shrinkable and heat-settable yarns. The fibrous web can be absorbent or nonabsorbent, and is preferably gatherable in MD. The stitch-bonded fabrics are heat treated while planarly restrained to set the stitch-bonding yarns and the stitch-bonded fabrics dimensionally at least in MD. The stitch-bonded fabrics can be heat set at its as-stitched or greige dimensions, or heat set as the fabrics gather in MD, or heat set as the fabrics is stretched in MD. Non-limiting suitable heat-settable stitching yarns comprise partially orientated yarns (POY) and bicomponent yarns. Another embodiment of the present invention is directed to stitch-bonded fabrics that combine the XD oriented fibrous web and the heat-settable stitching yarns.

Another embodiment of the present invention is directed to a method for making heat set stitch-bonded fabrics comprising at least a step of heat setting the stitch-bonded fabrics to dimensionally heat set the stitching yarns at least in MD. The fabrics may gather in MD, stretch in MD or maintain substantially the same MD dimensions during the heat setting step. A non-limiting suitable stitching yarn comprises partially orientated yarns (POY).

One embodiment of the present invention is directed to a stitch-bonded fabric comprising at least one fibrous web layer having a plurality of the fibers with a first length of more than about 25 mm, preferably more than 50 mm, more preferably over 75 mm, oriented substantially in a cross-direction (XD) of the stitch-bonded fabric at an angle of about 45° or less, preferably 30° or less, more preferably 15° or less from XD. The at least one fibrous web layer may have a basis weight from about 70 to about 300 grams/m$^2$, preferably from about 100 to about 200 grams/m$^2$, or preferably from about 125 to about 175 grams/m$^2$. The at least one fibrous web layer is stitch-bonded with yarns following a pattern of linear stitches along a machine direction (MD) spaced from about 1.4 mm to about 4.0 mm, preferably less than about 3 mm, more preferably less than 2 mm, along XD, and repeating with a spacing from about 0.8 mm to about 2.5 mm, preferably less than about 2 mm, more preferably less than 1.5 mm, in MD. The plurality of fibers having said first length are captured by multiple stitches. MD and XD are substantially orthogonal to each other. A density of fibers and yarn enclosed within the stitches is above about 0.10 g/cm$^3$ and below about 0.5 g/cm$^3$, preferably above 0.15 and more preferably 0.20 gram/cm$^3$, and the linear stiches are depressed below the exposed wales between the linear stitches along MD.

The at least one fibrous web layer may comprise more than 50% cellulosic fibers, and the at least one fibrous web layer may comprise non-absorbent fibers, or absorbent/hydrophilic fibers.

Preferably, the stitch-bonding yarns are heat set in at least MD. Also, preferably, the stitch-bonding yarns comprises POY yarns or shrinkable textured yarns or shrinkable bicomponent yarns. In some embodiments, the heat set comprises an embossed pattern.

A density of the at least one fibrous web layer may be less than about 0.12 g/cm$^3$, preferably less than about 0.09 gram/cm$^3$, more preferably less than about 0.06 gram/cm$^3$, and may have a thickness greater than about 1.0 mm and less than about 4 mm, preferably from greater than about 1.5 mm to about 3.0 mm. The at least one fibrous web layer may comprise a meltable layer positioned between two fibrous webs. The at least one fibrous web layer may also comprise a central layer of substantially unbonded and untangled fibers with a cellulosic content of greater than about 50% positioned between two absorbent or hydrophilic fibrous web layers. The at least one fibrous web layer may further comprise an additional layer on the technical front or technical back.

The at least one fibrous web layer may be further stitch-bonded with a second yarn forming protective underlaps of laid-in or stitched-in stitches. Alternatively, the second yarn may be meltable and may be co-stitched with the first stitch-bonding yarn.

Another embodiment of the present invention is further directed to a method for dimensionally stabilizing a stitch-bonded fabric comprising the steps of a. stitch-bonding a fibrous web layer with heat settable yarns, preferably POY yarns, shrinkable bicomponent or textured yarns, following pattern of linear stitches [preferably a chain stitch pattern] along a machine direction (MD) to form the stitch-bonded fabric;
b. tightening the stitches to maintain fibers from the fibrous web within the stitches by applying heat to the stitch-bonding yarns, while planarly restraining the stitch-bonded fabric, wherein a density of fibers and yarn enclosed within the stitches is above about 0.10 g/cm$^3$ and below about 5.0 g/cm$^3$, preferably above 0.15 and more preferably above 0.20 gram/cm$^3$;
c. optionally shrinking or stretching the stitch-bonded fabric in step b.

The tightening step (b) may comprise heating the stitch-bonded fabric to a temperature range from about 120° C. to about 250° C., preferably from about 150° C. to 190° C. The tightening step (b) may comprise embossing the stitch-bonded fabric.

The embossing step may comprise pressing a pattern having a depth of up to half of a thickness of the stitch-bonded fabric at a temperature above about 120° C., preferably 150° C. and more preferably 190° C., and below about 250° C.

When step (c) occurs, it may comprise gathering the stitch-bonded fabric at least about 10%, preferably at least about 20%, more preferably at least about 30%, by allowing the heat settable yarns to shrink. Step(c) may comprise stretching the stitch-bonded fabric at least about 10%, preferably at least about 20%, more preferably at least about 30%. The gathering is controlled by adjusting a heat treating temperature or by controlling the length of the stitch-bonded fabric and a distance between MD restraints.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENTS

Figure 1A:
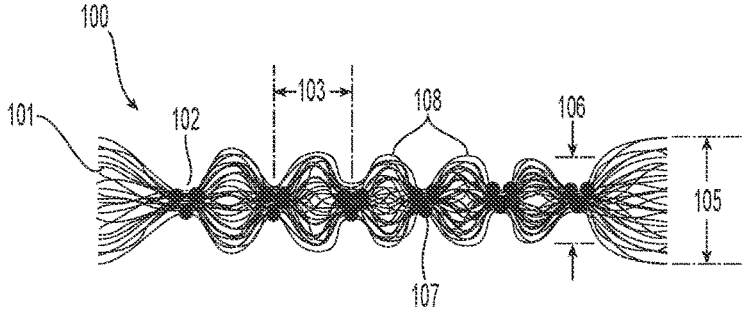
FIG. 1A is a cross-sectional view in XD.

Disclosed in one embodiment of the present invention are stitch-bonded fabrics having highly-absorbent surfaces. The fabrics in this embodiment include, at least one highly-bulky predominantly absorbent fibrous layer with a basis weight, a thickness and a density discussed above. Optionally, the highly-bulky predominantly absorbent fibrous layer is predominantly cellulosic, e.g., greater than about 50%. The fabrics are preferably stitched with a linear machine-direction (MD) pattern of yarns, e.g., chain stitch patterns, which are spaced apart with a Gage of 6-18 per inch or one stitch per 1.4 mm to one stitch per 4.0 mm in the cross-machine (XD) direction. The stitches are repeated at approximately 6-18 courses per inch (CPI) or every 1.4-4.0 mm in the MD.

Preferably, the stitches are formed with heat shrinkable yarns at a lower CPI and shrunk in the MD by applying heat to tighten the grip of the stitches. Optionally, the inventive fabrics are also allowed to planarly shrink or gather, mainly in MD, resulting in a final stitch length of approximately 0.8 to 2.5 mm after shrinking or gathering. Allowing longitudinal or MD gather in the fabrics increases the cross-directionality or XD directionality of the web fibers and, as a result, the cross-directional/XD stability of the composite product. With or without gather or shrinkage by the bulky fibrous layer, the localized pinched fibrous density within the loops formed by the stitches is raised above about 0.10 and preferably above about 0.15 grams/cm$^3$ or higher. The tightened or shrunk-and-tightened linear stitches improve the durability of the fabrics, and the stitch points also sink into the body of the bulky absorbent fabric layer, exposing the raised absorbent bulky fabric faces along the wales between the linear stitches to facilitate removal of liquid from wet surfaces and preserve the fabrics' speed of absorbency.

In another embodiment, the linear stitches on an absorbent or nonabsorbent fibrous layer are formed with partially oriented polymeric or POY yarns, such as polyester or nylon POY yarns. These yarns are capable of shrinking to 50% or less of their original length when subjected to temperatures as low as 100° C. When held or restrained within a length as small as 50% or less of their length and subjected to temperatures of 120° C. to 250° C., they can also be heat-set at their shrunk length. If the temperature is raised to the range of 165-190° C. (330 to 375° F.) the shrinkage can be achieved at high speeds with very short exposure times, with the yarns fully set and the fabric with minimal or no tendency to shrink or deform with washing and drying. Alternatively, other shrinkable yarns such as textured yarns, bi-component yarns, etc. can be utilized in addition to or in place of POY yarns.

As used herein, POY yarns are yarns made from fibers of partially molecularly oriented polymer, which means fiber of synthetic organic crystalline polymer that has substantial molecular orientation, but which still can achieve further molecular orientation. Yarn of partially molecularly oriented fiber is suited for use as stitching thread in the present invention and typically has a break elongation in the range of 50% to 150%. POY is described in U.S. Pat. No. 6,407,018, to D. P. Zafiroglu which is incorporated herein by reference in its entirety. As taught by the '018 patent, stitching thread of POY fiber typically has the capability of significant shrinkage when subjected, without restraint, to a low temperature heat treatment. For example, many POY yarns can shrink to less than half their original length when immersed in boiling water. Also, typical POY fiber can be heat set, while being held at constant dimensions, at temperature that is in the range of 120 to 190° C. The higher portion of the heat-setting temperature range (e.g., 165 to 190° C.) is preferred because the higher temperatures permit shorter exposure times to set the synthetic organic polymeric fibers. The fabric can be caused to shrink by being immersed in a relaxed condition in boiling water, or by being heated in a relaxed condition in air. The shrinkage can reduce the length and/or width of the fabric to less than 50% of the as-stitched dimensions and the planar area to less than 25% of its as-stitched area, while significantly increasing the thickness of the fabric over its as-stitched thickness.

In one preferred embodiment, the fabrics are planarly held or planarly restrained in MD as it is subjected to heat, causing the linear stitches to simply tighten and sink into the absorbent layer. The MD shrinkage and gathering of the fabric can be adjusted to a selected lower level by adjusting the overfeed during the heating process, at will. The linear stitches are heat-set while shrunk by raising the yarn temperature for a duration sufficient to set the yarns and by cooling the heated fabric as it is planarly restrained at the original, gathered or stretched length. Such heat setting substantially prevents the finished fabrics from further shrinking, deforming, or rolling-up in the machine direction they are washed and dried, while the stitches or stitch points remain tight around the enclosed fibers or filaments. Alternatively, the heating step may occur without the overfeeding, so that the stitched fabrics maintain their as stitched dimensions after the stitching yarns are set. Also, alternatively the stitched fabrics are stretched during the heating step while the stitching yarns are set to obtain set stitched fabrics that have elongated MD dimensions, even as the stiches around the enclosed fibers are tighter than they were as stitched and the enclosed fibers are more compacted.

In one preferred embodiment, the absorbent web layer is formed with continuous filaments or long staple fibers aligned predominantly in XD or close to XD. This fiber orientation reduces the tendency of fibers to be pulled from either surface during abrasive or wiping use or during washing or drying, as they are tightly held multiple times by the tightened or shrunk linear stitches along their length. The predominantly cross-directional orientation also facilitates compaction within the stitches, as well as longitudinal/MD gathering, and allows the use of lighter yarns of lower deniers to accomplish the compaction within the stitches. Preferably, a plurality of the fibers in the absorbent layer or at least at the outer strata of the absorbent layer, are at least 2 inches or 5 cm long, more preferably over 3 inches or 75 mm long. In one embodiment, at least some these absorbent fibers are continuous filaments. In one embodiment, the absorbent fibers consist partly of staple fibers and partly of continuous filaments. In one embodiment the absorbent fibers are cross-lapped into a predominantly cross-aligned or XD aligned web before stitching. The predominant cross-alignment of the fibers also increases the cross-directional stability of the product as the MD shrinking also aligns the web fibers further in the cross direction. Optionally the absorbent fibrous web layer is minimally tacked, mechanically or adhesively, and more preferably untacked and loose. In one application, low-melt elements such as powders and fibrils within the web are present, but not activated until heat is applied to shrink the stitches, or until the surface is lightly retouched with heat to stabilize it without affecting the shrunk or unshrunk stitches.

In other embodiments, the absorbent layer comprises two, three or more layers of primarily XD oriented long absorbent fibers or filaments, allowing the generation of higher bulk per unit area, and the balancing of the properties of the outer layers vs. the inner layers, including, but not limited to properties such as density, color shade, fiber denier, adhesive content, and fiber directionality. In one embodiment, stiffer and coarser fibers increasing bulk are confined within the inner layers. In another embodiment, a relatively low percentage of stiffer, highly-crimped, or absorbent/nonabsorbent fibers are placed within the inner layers, contributing to bulk and avoiding interference with the speed of liquid pick-up by the outer surfaces or outer layers.

In another embodiment, two highly-cross-directional outer layers comprising long fibers or filaments enclose an inner layer of primarily absorbent multi-directional shorter fibers, such as webs of recycled fibers, cotton fibers, cotton linters, or cellulosic pulps. The cross-directional fibers or filaments of the outer layers gather on the surfaces of the wales to contain the inner absorbent layer as the stitched fabric is shrunk MD. The combined density of the overlaid layers, the overall density of the final finished composite, and the localized final density within the shrunk stitches are maintained within the same ranges as in the case of single or multiple absorbent webs of primarily cross-directional absorbent fibers, discussed herein.

In one embodiment, about 20% or less, preferably 10% or less, more preferably 5% or less of low-melting polymeric powder, fibrils or fibers, with melting points significantly below the degradation temperatures of the absorbent cellulosic fibers, in the range of about 100° C. to about 200° C., are blended or layered with the absorbent fibers, and are activated with heat, after stitching or during shrinking process or after shrinking, to increase the fabrics' durability without a substantial negative effect upon surface absorbency or total absorbency, and a minor to negligible effect upon the surface's softness. In another embodiment, the absorbent layer is lightly bonded with low-melt powder applied to the absorbent layer before stitch-bonding, or after stitch-bonding, and activated before or after stich-bonding or both, and before or during the process of shrinking. Optionally, one or both surfaces of the shrunk fabrics containing binder fibers or low-melt powder are additionally re-touched with a heated tool to impart a smoother or rougher finish as desired or needed. In one embodiment, the surface modifications may be performed by applying radiant heat or heated air to the surface and then contacting it with a cooled roll or plate. The heating and surface-patterning can be performed with a patterned heated roll or plate applying minimum pressure to avoid compaction, followed by cooling with or without cool air. One or both of two surfaces can be treated with beat. The presence of activated binder fibers or powders further reduces the tendency of cut-edge linting or stitch unraveling during laundering or during abrasive use.

In another embodiment, the shrunk or unshrunk or tightened or not tightened fabric that consists of a web of primarily cross-directional absorbent fibers stitched with linear POY yarns and having a stitch spacing of 6-18 per inch in both MD and XD directions and a fiber absorbent fiber density over about 0.10 gram/cm$^3$ preferably over about 0.15 gram/cm$^3$ within the stitches or stitch points, is embossed with a three-dimensional pattern at a temperature in the range from about 160 to about 190° C. (320 to 375° F.) and up to 250° C. The embossed texture is preferably at least as deep as one half of the thickness of the stitch-bonded fabrics. The exposure to temperatures in the high range of heat-setting during the embossing process rapidly shrinks the stitches and sets the POY yarns during the relatively short exposure to heat at the nip of the heated embossing rolls, as the product maintains its embossed texture and consequently its overall bulk, its surface integrity and cut-edge integrity, as well as its flatness and its absorbency after repeated machine washings and dryings, without the need of low-melt fibers or any type of polymeric bonding. The first washing and drying step also dramatically softens the product and improves its absorptive capabilities.

In one further embodiment, bulky absorbent layers are positioned above and below a low-melting polymeric adhesive layer, such as a film or a thin low-melting nonwoven, prior to stitching. The central low-melt layer softens or melts and does not resist the stitch-tightening process, or the optional gathering of the product in MD, as it helps to stabilize the final composite without hardening the surfaces or the entire the product, and without retarding surface absorbency.

In another embodiment, a second yarn is co-stitched along with the shrinkable yarn. In one example, the second yarn can be a low-melting polypropylene or polyethylene yarn, or a polyester or nylon yarn. In a non-limiting example, the two yarns are fed into two separate bars, preferably in an opposing pattern, such as 10-01/01-10, or 00-11/11-00. Preferably, the two yarns are combined before warping onto a beam. In one embodiment, a low-melt yarn and the shrinkable yarn are co-fed from two separate beams into the same pattern bar during stitching. The low-melt yarn melts and bonds the fibers of the absorbent layer, which are enveloped and pinched by the tightly stitched or post-shrunk stitch loops. The shrunk stitches are depressed further below the level of the two surrounding wale surfaces, as the high-bulk absorbent layer remains thicker within the wales between the MD linear stitches. The pinched bonding at the stitches, combined with the short distances between stitches in both MD and XD, improves the fabrics' durability, and limits unraveling or linting at the cut edges.

In yet another embodiment, the surface corresponding to the technical back of the stitched absorbent fabric is protected by laid-in and preferably absorbent or hydrophilic yarns inserted in a diagonal pattern across the linear stitches. Laid-in yarns using patterns going over one to four wales, such as 00-22, 00-33, 00-44 and 00-55, etc. will gather along the machine direction in a planar fashion into tighter zig-zag patterns with sharp angles as the linear stitches shrink and gather the fabric in MD, will not offer substantial resistance to MD shrinkage, but will protect the absorbent layer, and add to the texture, the scrubbing capability and the durability of the technical back of the fabric. The protective underlaps may also originate from stitched-in yarns combined with the linear shrinkable yarns from a separate beam and bar, utilizing tricot stitches such as 10-12, 10-23, 10-34, etc.

In some embodiments the yarns forming the protective underlaps may also be shrinkable, and shrinkage is allowed mostly or only in the machine-direction MD, most commonly by holding the fabric with edge pins as it gathers in the MD in a finishing frame. A small amount of cross-directional XD shrinkage in the range of about 5% to about 15% may optionally be allowed and can help to bulk and raise the absorbent mid layer fibers laying closer to the cross direction within the wales. The tendency to shrink mainly or substantially in MD with minimal resistance is a natural consequence of a web itself having fibers mainly oriented in XD, as in the case of carded and cross lapped webs of long staple fibers or cross-lapped filament warps, resisting XD gathering but easily allowing and not interfering with MD gathering.

In another embodiment, one outer hydrophobic water-blocking, water-resistant or water-proof layer, such as a polyolefin or polyester film or a microfiber melt-blown or plexifilamentary nonwoven is placed over or under a bulky absorbent web before stitching. The stitched fabric is post-treated at a moderate temperature to avoid melting the exposed nonwoven or film and to allow the fabric to gather in the MD causing the stitching holes to at least partially close and partially or fully restore the liquid-penetration resistance of the added outer layer to prevent leakage. In one embodiment, the linear stitching yarns also include a low-melt yarn co-stitched with a shrinkable stitching yarn, as discussed above, so that as the fabric shrinks and the outer water blocking layer gathers and reduces the size of the perforations in the added layer created by the stitching needles, the low-melt yarns melt and further reduce or fully seal the open areas of the stitched holes. Still further, when the protective water-resistant layer is placed against a surface, such as a floor protected from spills, it also forms concave inner cross-directional/XD channels that help to contain spills by directing spilled liquids across in the XD.

In a different embodiment, two protective layers are placed above and below a relatively loose bulky absorbent or nonabsorbent web containing relatively loose fibers. The inner web does not offer substantial resistance to the shrinking yarns. At least one outer layer is a thin, flexible and durable absorbent layer. In one embodiment usable for absorbent or spill control applications the inner layer comprises absorbent fibers and the outer layers are woven or knit fabric prepared with rayon or lyocell filament fibers, or rayon or lyocell preferably hydroentangled and soft nonwoven fabric prepared with staple fibers or filaments or both. One of the outer layers can be absorbent or simply hydrophilic as in the case of a very fine nylon woven, nonwoven or knit filament fabric. In one embodiment usable for nonabsorbent applications such as cushioning or insulating, the inner fibrous web is nonabsorbent and the outer layers are similarly constructed with nonabsorbent, thin and compliant woven, knit or nonwoven layers. In other embodiments, the central bulky absorbent layer that may comprise a variety of relatively loose and randomly oriented absorbent fibers offering minimum resistance to planar or vertical compaction, including shorter cellulosic fibers such as cotton fibers or cotton linters or recycled absorbent fibers, or wood pulp. In one variation, these contained fibers are mixed-in with small portions of non-absorbent stiffer or more crimped fibers such as polyester fibers oriented in any or all directions to help maintain high bulk and high absorptive capacity. Optionally, the central layer also contains from about 5% to about 20% low melt fibers, particles or powders. As in the case of highly cross-directional absorbent layers using long fibers, the stitches are sunk below the adjacent wales, and the density of the fibrous material pinched within the shrunk the linear stitches rises above about 0.10 gram/$cm^3$, preferably above about 0.15 gram/$cm^3$, preferably over about 0.20 gram/$cm^3$. The fabric may also be allowed to gather in MD, by providing relatively softer and more flexible outer layers.

Figure 1B:
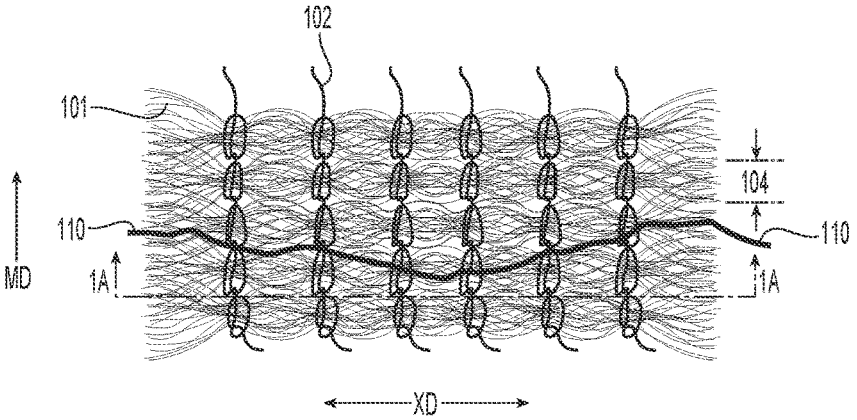
FIG. 1B is a planar view of a stitch-bonded absorbent fabric layer.
Figure 1C:
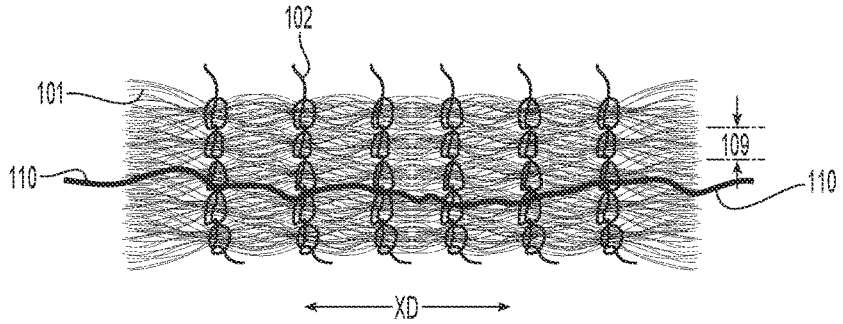
FIG. 1C is the fabric layer of FIG. 1B after it is tightened and further bulked by causing the stitching yarns to shrink in MD

An exemplary stitch-bonded fabric 100 is illustrated in FIGS. 1A-1C. Stitch-bonded fabric 100 may have one or more webs being stitch-bonded by one or more stitching yarns. In one example, web 101 is stitched with yarns 102 using a linear stitch pattern, e.g., chain stitches, shown in cross-section in FIG. 1A and with a planar view of the technical back, as shown in FIG. 1B. The technical back is the top surface of the fabrics/webs as they are being stitched. The stitch spacing 103 and stitch length 104 of the greige fabric, as stitched, are relatively small, 6-18 Gage and 6-18 CPI, limiting the width of exposed wales and the length of web exposed when the fabric is cross-cut. Preferably, the fibers within web 101 are mostly oriented in the XD direction, or closer to XD than MD. In other words, these fibers may be in a diagonal direction, preferably at an angle less than about 45° from XD, more preferably less than about 30° from XD and more preferably less than about 15° from XD. In this manner, an exemplary fiber 110 is enclosed and held multiple times by adjacent stitches, as illustrated in FIGS. 1B and 1C. For example, a 50 mm (2 inch) fiber laying at about 45° angle would pass through about 13 tightened loops at 9 Gage. In one non-limiting example, the web is a cross-lapped web of fibers longer that 25 mm (about 1 inch). The more predominant cross-directionality XD is usually achieved by cross-lapping a carded web or a filament warp at a lower machine-directional MD speed and a higher cross directional XD speed. Preferably, a plurality of the fibers are at least 50 mm (about 2 inches) long, preferably longer than 75 mm (3 inches), and optionally in the form of continuous filaments. Moreover, the cross-directional web offers low or zero resistance to shrinkage in MD. The original thickness 105 of web 101 is reduced to thickness 106, with the stitches 107 depressed or sunk or submerged between the elevated wale areas 108. Within stitches 107 or their vicinity, the enclosed web density is raised above 0.15 gram/$cm^3$, above the original web density, which is usually lower than 0.10 grans/$cm^3$, and preferably less than 0.06 gram/$cm^3$. The weight of the absorbent web, the stiffness of the fibers, and the denier or shrinking power of the linear stitched yarn must be balanced to ensure that when the stitches shrink there is sufficient fiber mass enclosed within the stitches to increase density above 0.15 gram/$cm^3$, preferably above 0.20 gram/$cm^3$.

Referring to FIG. 1C, the stitches are optionally shrunk to stitch length 109 by raising the temperature, further increasing the density of the fibers enclosed and pinched within stitches 107, and further securing the web fibers. The shrinking also causes the fibers along the wales 108 between the stitches to be forced slightly further above the stitches.

In one embodiment, the heat treatment may be performed with the stitched web free to shrink without any restraint, as in the case of washing and drying. In other preferred embodiments heating or steaming is performed with linear or planar restraints. The level of shrinking can optionally be controlled by adjusting the length or width of the fabric, or both the length and width between restraints, for example by overfeeding between nip rollers for MD control, or with pins along the edges for cross-directional control. The fabric is preferably tightened by heating and cooled in a flat state before being submitted to washing and drying. More preferably the fabric is set with heat at temperatures above 120° C., most preferably at temperatures in the range of from about 160° C. to about 190° C.

Figure 2:
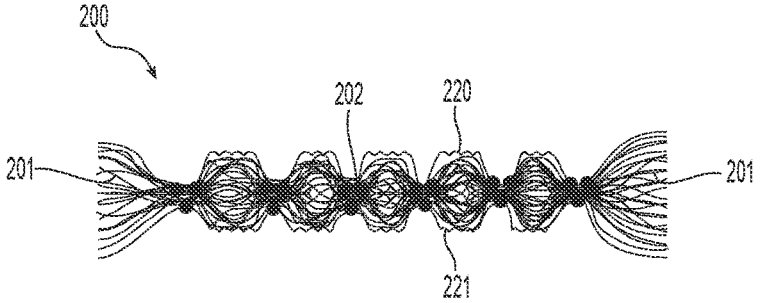
FIG. 2 is a cross-sectional view in XD of the fabric of FIG. 1A containing a small percentage of low-melt fibers or powders and lightly touched on the top surface with heat and a tool of fine texture, and on the bottom with a heated tool of a rougher texture.

Referring to FIG. 2, in another embodiment the highly cross-directional absorbent layer 200 contains from about 2% to about 20%, preferably from about 5% to about 10% low-melt fibers, and the top surface 220 along the wales between the stitches is touched or treated with heat to further stabilize it without collapsing the hulk exposing the stitches. Optionally or additionally, the lower surface or technical back 221 is also retouched with light pressure and in the case of absorbent webs, the scrubbing ability. Low-melt, as used herein, means the melting temperature lower than the melting temperature of the fibers forming the web and/or the stitching yarns.

Figure 3A:
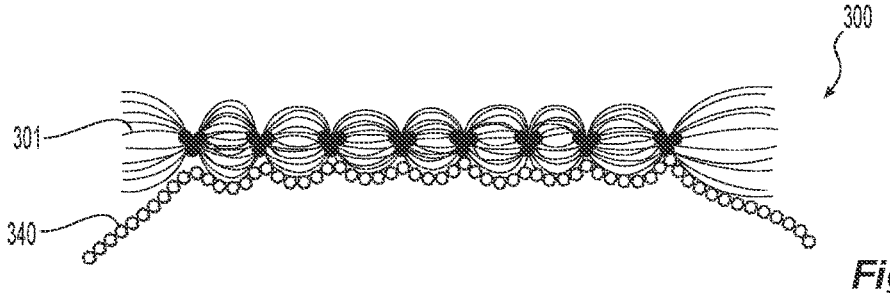
FIG. 3A is a cross-sectional view of a fabric of FIG. 1A, wherein a protective layer of laid-in yarns is additionally formed on the technical back of the fabric.
Figure 3B:
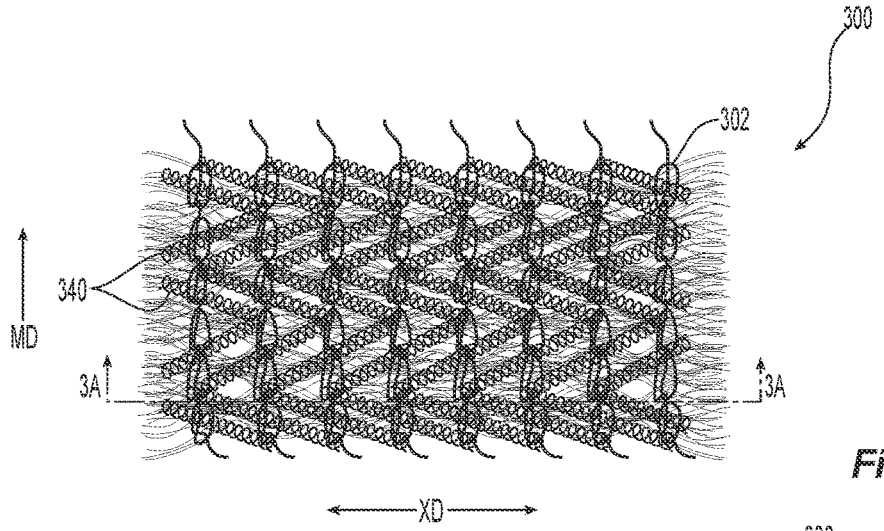
FIG. 3B is a planar view illustrating the technical back of the same fabric as stitched.
Figure 3C:
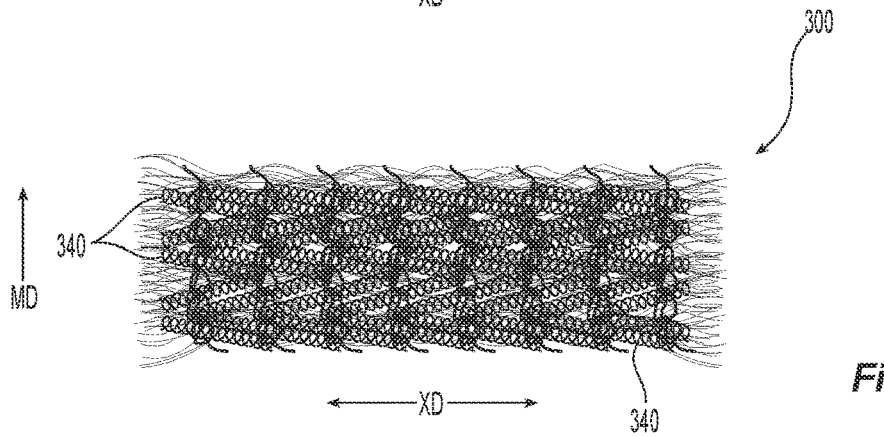
FIG. 3C shows the fabric of FIG. 3B after the tightening of the stitches and the gathering of the laid in yarns.
Figure 3D:
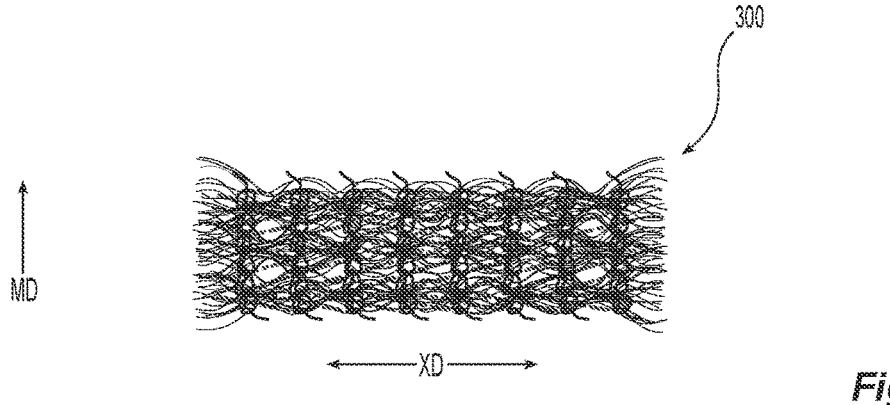
FIG. 3D shows the fabric after shrinking the stitched fabric in both MD and XD.

In another embodiment illustrated in FIGS. 3A and 3B, the technical back of stitch-bonded fabric 300 is covered with a layer of laid-in yarns 340 originating from a separate bar and a separate beam protecting absorbent web 301. Referring to FIG. 3C, as linear stitches 302 shrink, laid-in underlaps 340 gather and cover the technical back of the fabric with a higher density. Referring to FIG. 3D, a small amount of cross-directional XD shrinkage may also be obtained by the independent shrinkage of the laid-in underlaps 340 increasing the bulking, as discussed above.

Figure 4:
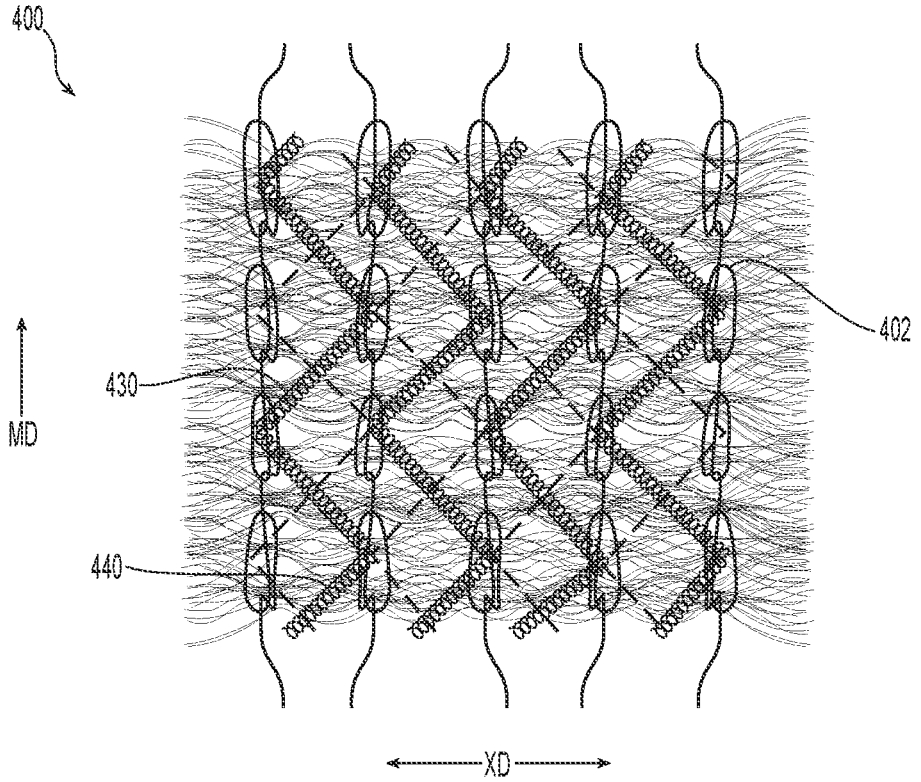
FIG. 4 is a planar view of a fabric equivalent to the fabric of FIG. 3 wherein two laid-in stitches are placed in opposition of each other.

In another embodiment illustrated in FIG. 4, more than one laid-in bar can be deployed on the technical back of the fabric 400 with the third bar 440 preferably in opposition to the second bar 430, as shown, adding further coverage to the technical back.

Figure 5:
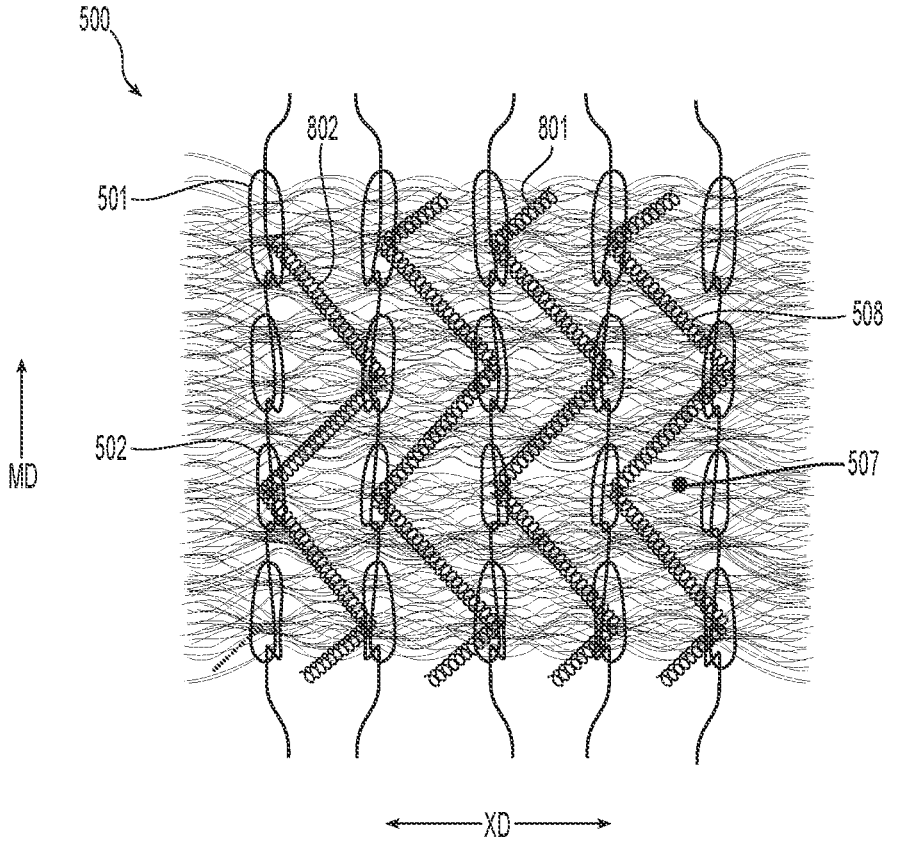
FIG. 5 is a planar view of a fabric equivalent to FIG. 3 wherein one laid-in stitch is replaced with a stitched-in tricot stitch.

In another embodiment, illustrated in FIG. 5, a companion tricot stitch 502 is added to the linear stitch 501. The linear stitch is tight, and shrinkable, whereas the tricot stitch is either loose or non-shrinkable or less shrinkable, protecting the exposed wales 507 along the technical back with underlaps 508. As in the case of the laid in yarns 340 of FIG. 3 or the laid-in yarns 430 and 440 of FIG. 4, the shrinkage of the underlaps 440 and consequently the cross-directional shrinkage of the overall fabric 500, can be controlled by using edge-pins in a finishing frame.

Figure 6:
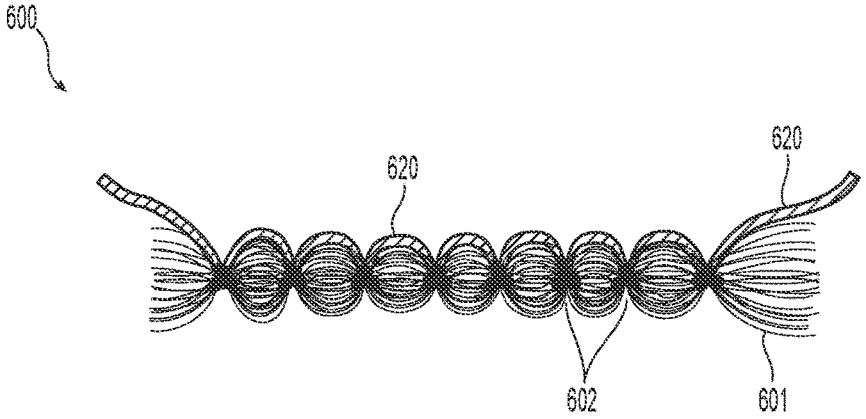
FIG. 6 is a cross-sectional view of the fabric of FIG. 1A wherein the top surface corresponding to the technical front additionally includes a protective thin absorbent fabric.

In another embodiment illustrated in FIG. 6, a thin durable fabric 620 is placed under an absorbent highly cross-directional or cross-lapped web 601 stabilizing the technical front before applying tight or post-tightened linear stitches 602. For absorbent applications, fabric 620 is preferably also hydrophilic, such as a very fine nylon filament knit, or more preferably absorbent, such as a woven or knit or nonwoven containing cellulosic fibers, including rayon, lyocell, cotton or wood pulp. In one embodiment, fabric 600 is shrunk in MD with heat to cause fabric 620 to gather and bulk up.

Figure 7:
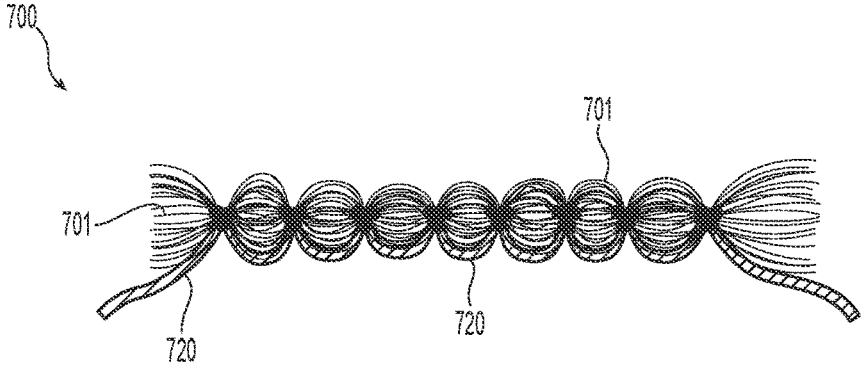
FIG. 7 is a cross-sectional view of a fabric wherein a hydrophobic liquid blocking sublayer is placed under the absorbent layer, before stitching along the technical front.

In a variation of the embodiment of FIG. 6, referring to FIG. 7 the protective layer is a liquid-blocking layer 720, for example a plastic film or plexifilamentary or microfiber nonwoven or a membrane is placed underneath against the technical front or above along the technical back, resisting the tendency of liquid absorbed through the opposite face from exiting. Optionally, as discussed above, in one embodiment two yarns are stitched linearly, and one of the stitching yarns is a shrinking yarn and the second yarn is a low-melt yarn. The low-melt yarn bulks-out and melts during heat treatment and partially or fully blocks the stitched holes. Preferably, the liquid impermeable layer is also air-permeable to increase the comfort for the wearers or users.

Figure 8:
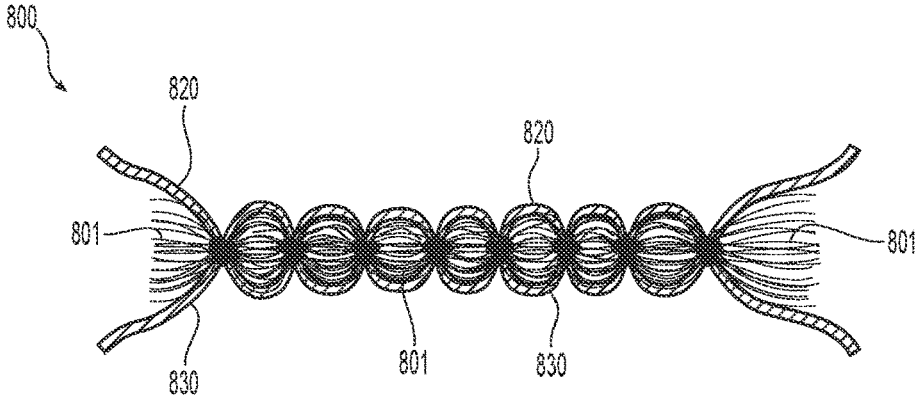
FIG. 8 is a cross-sectional view of a fabric wherein both the top and bottom surfaces include added thin layers protecting a randomly oriented bulky absorbent mid-layer and blocking the exit of fine fibers included in the absorbent layer.

In another embodiment illustrated in FIG. 8, two hydrophilic or absorbent layers 820 and 830 are placed above and below a relatively loose bulky web 801. These layers are selected to be sufficiently dense to contain loose inner and shorter fibers from web 801, and also to be gatherable in the MD, with the heat applied to tighten the stitches The bulky absorbent layer 801 contains absorbent fibers, that may or may not be long fibers or fibers laying highly in the cross-direction, and may also contain short fibers or pulps oriented in all three directions. Both of the outer layers bulk out of plane, as stitched fabric 800 is shrunk. Optionally, the absorbent layer 801 includes shorter fibers, and post-industrial or post-consumer recycled fibers such as cotton, rayon, lyocell, cotton linters, or wood pulp. In one embodiment, the enclosed absorbent web 801 also contains a small portion of higher denier, or highly crimped shorter fibers to increase and maintain bulk and absorptive capacity, without shedding out or coming out through the outer layers 820 or 830. In one embodiment the enclosed web 801 also includes a limited amount of low-melt powder to allow heat-sealing the cut-edges of stitch-bonded fabric 800. In selected embodiments the absorbent layer is a lightly tacked or slightly bonded or hydraulically entangled bulky nonwoven. In selected embodiments, the absorbent layer consists of multiple superposed webs or nonwoven layers directly fed into the stitch-bonding machine between the protective layers with gradually converging belting.

Figure 9A:
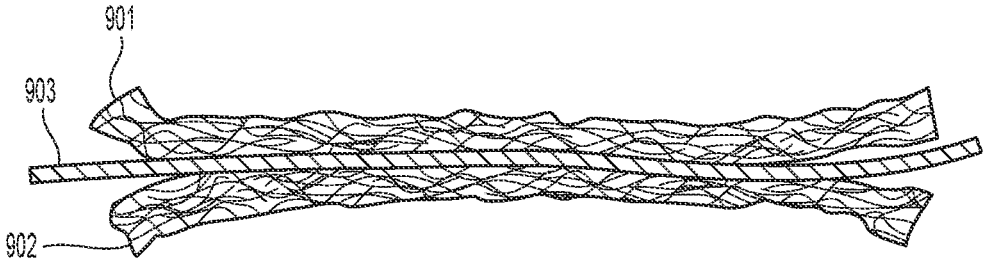
FIG. 9A is a cross-sectional view of an assembly of layers wherein a low melting layer is placed between two bulky layers, stitched with shrinkable yarns, as shown in FIG. 9B, and tightened and internally bonded with heat as shown in FIG. 9C.
Figure 9B:
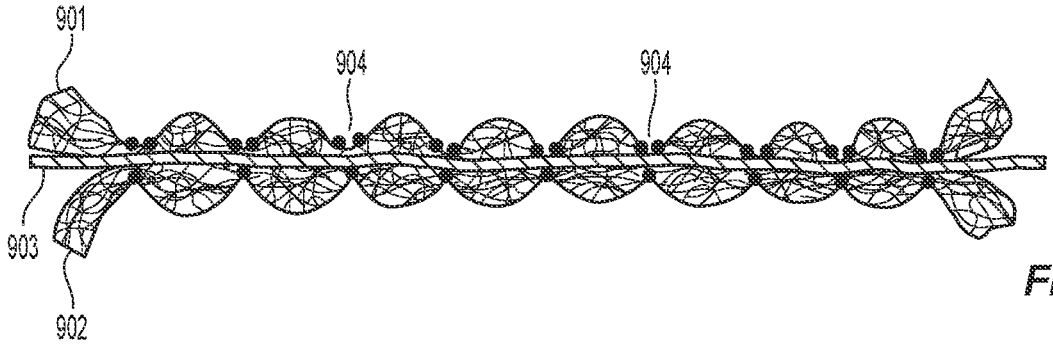
Figure 9C:
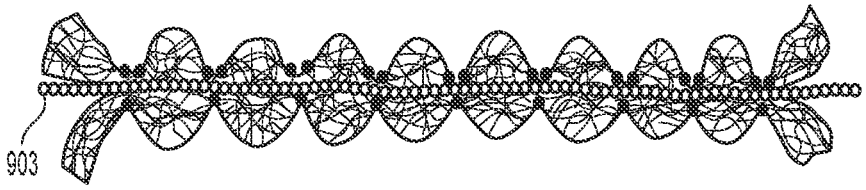

In another embodiment illustrated in FIG. 9A, a bulky layer 901 is placed above and a second bulky layer 902 is placed below a low-melt polymeric layer 903. As shown in FIG. 9B, the three layers are stitched with tight yarns 904. As shown in FIG. 9C yarns 904 may also be shrinkable and further tightened with heat to cause the stitches to sink further below the surfaces of the fabric, while the mid-layer 903 melts and bonds the layers and stitches to each other, increasing dimensional stability and durability without affecting the softness and the absorptive speed of the outer surfaces.

The various embodiments of the present invention are illustrated in the following non-limiting examples.

Example 1

(FIGS. 1A-1C). Durable Bulky and Absorbent Sheet

Substrate: Two layers of cross-lapped card web prepared with 2.5-inch (63.5 mm) long rayon fibers, each layer weighing approximately 1.8 oz/yd$^2$ or 60 grams/m$^2$. The combined initial thickness of the stacked layers was approximately 2.0 mm, and the combined density is about 0.06 g/cm$^3$.

Stitching: 10-01 with 235 denier POY polyester, 14 gage/14 CPI.

The stitched weight was approximately 4.9 oz/yd$^2$ or 165 gram/m$^2$, with 73% cellulosic fibers and 27% polyester yarn.

Fabric temperature was raised to approximately 185° C. (365° F.) for approximately 20 seconds and the fabric was planarly restrained and allowed to shrink to 18 CPI, approximately 6.3 oz/yd$^2$ or 210 grams/m$^2$. The stitches were shrunk below the level of the adjacent wales, on both the technical front and the technical back, with the thickness at the stitches approximately one half of the thickness along the wales.

The final fabric was approximately 1.8 mm (0.070 inch) thick over the wales, with an overall bulk of approximately 0.12 gram/cm$^3$. The density of fibers enveloped by the linear stitches was estimated to be above 0.24 grams/cm$^3$, based on the approximately 50% lower thickness within the stitches, without counting the contribution of the yarns and the circular or elliptical cross-section within the stitches.

The fabric was highly absorbent, with planar shrinkage limited to less than 5% and with no sign of surface deterioration, no warping or rolling and no edge-unraveling after 20 washings and dryings.

Example 2

Fabric Finished with Heat by Tightening the Stitches without Gather

The fabric of Example 1 was planarly restrained in the MD, subjected to 185° C. (365° F.) for approximately 20 seconds and cooled under restraint, with the final weight staying at 165 grams/m$^2$.

The thickness over the wales was approximately 1.5 mm, and the stitches shrunk under the level of the wales to approximately 0.9 mm.

The density of fibers within the stitches was estimated to be approximately 0.18 grams/cm$^3$.

The fabric exhibited the same properties after multiple washings and dryings as in Example 1, with slightly lower absorptive capacity.

Example 2A

Thin Absorbent Layer, Lower Stitch Tightness

The process of Example 2 was repeated with the exception that the absorbent layer consisted of a single 1.8 oz/yd$^2$ or 60 grams/m$^2$ rayon web.

Stitched greige weight and finished weight were 3.3 oz/yd$^2$ or 110 grams/m$^2$, with absorbent fiber at 58 wt. %.

The finished overall thickness was 1.1 mm at the wales and 0.6 mm at the stitches.

Fibrous density within the shrunk stitches was estimated to be approximately 0.10 grams/cm$^3$.

Although the fabric remained stable and flat after several washing and drying cycles it was planarly deformable in the cross direction as the web fibers slipped within the stitches, and failed after 5-10 washing cycles.

It is noted that when a higher density web or when two or more of the webs similar to Example 2 are used in this Example, more web fibers would be available at the stitches to improve the retention of web fibers within the stitches.

Example 3

Thin Absorbent Layer/High Stitch Shrinkage

The process of Example 2A using a single web layer was repeated with the exception that the fabric was allowed to shrink and gather when subjected to the same temperature for the same duration with no planar restraint.

The basis weight increased from 3.3 oz/yd$^2$ or 110 grams/m$^2$ to 6.6 oz/yd$^2$ or 220 grams/m$^2$ and the CPI from 14 to 27 courses per inch.

Thickness over the wales was 1.6 mm and over the stitches at 0.8 mm.

Fibrous density within the tightened stitches was estimated to be over 0.20 gram/cm$^3$.

The fabric remained flat, with a stable surface, table planar dimensions, and stable cut edges after 20 wash/dry cycles.

Example 4

(FIG. 9). Durable Absorbent Sheet with Polymeric Central Adhesive Layer

A sheet of plexifilamentary polyethylene nonwoven (Tyvek®) weighing 1.9 oz/yd$^2$ or 63 grams/m$^2$ was placed between the two webs of Example 1. Total weight before stitching was 5.5 oz/yd$^2$ or 183 grams/m$^2$.

The assembly was stitched with the same yarn and stitching system and finished as in Example 1 at 185° C. allowing the fabric to gather to 18 CPI.

The central polyethylene layer melted and did not interfere with the gathering, and further stabilized the fabric.

Total weight after stitching was 7.8 oz/yd$^2$ or 260 grams/m$^2$ and after gathering 10 oz/yd$^2$ or 333 grams/m$^2$.

The density of fibrous material the tightened stitches was estimated to be at least 0.30 gram/m$^3$.

The fabric had the same stable and durable properties as the fabric of Example 1, except far superior machine and cross-directional stability and strength, and surprising softness after washing.

Example 5

(FIG. 7). Durable Drop Cloth/Bath Rug/Cold Weather Jogging Apparel

Same absorbent web assembly as Example 1 placed at the technical front side under the plexifilamentary nonwoven of Example 4 and stitched as in Examples 1-3, but shrunk from 14 CPI to 18 CPI under partial planar restraint at approximately 125° C. (260° F.) to avoid melting the outer nonwoven.

Greige weight or as stitched basis weight was approximately 7.8 oz/yd$^2$ or 260 grams/m$^2$ and after gathering 10 oz/yd$^2$ or 333 grams/m$^2$.

This fabric was also surprisingly soft but very strong, conformable and durable, with an estimated fibrous density within stitches above 0.30 gram/cm$^3$.

Excess water spilled on the technical front side was observed to tend to spread laterally.

The table below summarizes Examples 1-5.

| Example | Web(s) | Restraint $CPI_b$-$CPI_a$ (stitch distances) | Temp. (20 sec) | Basis Wt. Greige/ Finish | Density w/in stitches |
|---|---|---|---|---|---|
| 1 | 2 Rayon | Partial 14-18 (1.8 mm-1.4 mm) | 185° C. | 4.9/6.3 | 0.24 |
| 2 | 2 Rayon | Full 14-14 (no change) | 185° C. | 4.9/4.9 | 0.18 |
| 2A | 1 Rayon | Full 14-14 (no change) | 185° C. | 3.3/3.3 | 0.10 |
| 3 | 2 Rayon | None 14-27 (1.8 mm-0.9 mm) | 185° C. | 3.3/3.3 | 0.20 |
| 4 | Rayon-Tyvek ®-Rayon | Partial 14-18 (1.8 mm-1.4 mm) | 185° C. | 7.8/10 | 0.30 |
| 5 | 2 Rayon-Tyvek ® | Partial 14-18 (1.8 mm-1.4 mm) | 125° C. | 7.8/10 | 0.30 |

The restraint can be full, i.e., allowing no change in the CPI-before and CPI-after heat treatment; partial, i.e., allowing the CPI-after to be higher (more courses per inch) than the CPI-before but less than maximum; none, i.e., the yarns are allowed to be free to fully gather or shrink. The stitch distances are based on the CPI, e.g., for 14 CPI, the stitch distance is 25 mm/14=1.8 mm. The basis weights are in grams/cm$^2$, and the density is gram/cm$^3$.

The inventors note that the inventive stitch-bonded fabrics are fully functional without the heating or heat setting step, i.e., the heating is optional, and heating without constraint is also optional, so long as the density within the linear stitches is 0.10 gram/cm$^3$ or higher. The un-heated embodiments would still need to have the same density of fibers within the stitched loops, and the same CPI/stitch distances as the heated embodiments. Without heating or heating without constraint, the stitch-bonded fabrics can be utilized in applications where dimensional stability or planar stability is not required, e.g., insulative applications, light-use towels, etc.

The present invention relates to highly-durable, reusable and washable stitch-bonded nonwoven fabrics and to stitch-bonded nonwoven fabrics that have their dimensions set and maintain a flat planar configuration. Such fabrics can be used as absorbent pads, such as those for absorbing cooking meat fats; non-disposable diapers; sanitary products; protective bed pads; reusable towels; paint drip cloths; nonabsorbent or absorbent dimensionally stable fabrics for surface covering applications such as flooring and wallcoverings, window blinds, and the like.

The present inventors also note that while the fibers of the fibrous web layer are described herein as being oriented substantially in a cross-direction (XD) of the stitch-bonded fabric at an angle of about 45° or less, preferably 30° or less, more preferably 15° or less from XD, these fibers are not geometrically straight lines, as illustrated by reference number 110 in FIG. 1B. Instead, as used herein the angle of these fibers can be approximated by their general orientation relative to XD.

While it is apparent that the illustrative embodiments of the invention disclosed herein fulfill the objectives stated above, it is appreciated that numerous modifications and other embodiments may be devised by those skilled in the art. Modifications may involve a variety of face fabrics, absorbent fibers and the like. Other modifications may involve the use of fibrous or non-fibrous, resilient inner layers that may be absorbent or non-absorbent, and may contain materials of various mechanical, electrical, or chemical properties. Therefore, it will be understood that the appended claims are intended to cover all such modifications and embodiments, which would come within the spirit and scope of the present invention.

What is claimed is:

1. A stitch-bonded fabric comprising:

at least one fibrous web layer ci) having a basis weight from about 70 to about 300 grams/$m^2$ and (ii) a density of less than about 0.09 gram/$cm^3$, and (iii) comprising a plurality of fibers with a first length of more than about 50 mm, wherein a XD orthogonal component of said plurality of fibers is about the same as or greater than a MD orthogonal component of said plurality of fibers, wherein the at least one fibrous web layer is stitch-bonded with yarns following a pattern of linear stitches along MD spaced from about 1.4 mm to about 4.0 mm along XD, and repeating with a spacing from about 0.8 mm to about 2.5 mm in MD, wherein the plurality of fibers having said first length are captured by multiple stitches, wherein MD and XD are substantially orthogonal to each other, and wherein a density of fibers and yarn enclosed within the stitches is above about 0.10 g/$cm^3$ and below about 0.5 g/$cm^3$ and wherein the linear stiches are depressed below exposed wales between the linear stitches along MD.

2. The stitch-bonded fabric of claim 1, wherein a density of fibers and yarn enclosed within the stitches is above about 0.15 g/$cm^3$.

3. The stitch-bonded fabric of claim 1, wherein the at least one fibrous web layer comprises more than 50% cellulosic fibers.

4. The stitch-bonded fabric of claim 1, wherein the at least one fibrous web layer comprises non-absorbent fibers.

5. The stitch-bonded fabric of claim 1, wherein the at least one fibrous web layer comprises absorbent or hydrophilic fibers.

6. The stitch-bonded fabric of claim 1, wherein the stitch-bonding yarns are heat set in at least the MD.

7. The stitch-bonded fabric of claim 6, wherein the stitch-bonding yarns comprises partially oriented yarns or shrinkable textured yarns or shrinkable bi-component yarns.

8. The stitch-bonded fabric of claim 6, wherein the stitched-bonded fabric comprises an embossed pattern.

9. The stitch-bonded fabric of claim 1, wherein the at least one fibrous web layer has a density below about 0.06 g/$cm^3$.

10. The stitch-bonded fabric of claim 1, wherein the at least one fibrous web layer has a thickness greater than about 1.0 mm and less than about 4 mm.

11. The stitch-bonded fabric of claim 6, wherein the at least one fibrous web layer comprises a meltable layer positioned between two fibrous webs.

12. The stitch-bonded fabric of claim 1, wherein the at least one fibrous web layer comprises a central layer of randomly oriented and substantially unbonded and untangled fibers with a cellulosic content of greater than about 50% positioned between two absorbent or hydrophilic web layers.

13. The stitch-bonded fabric of claim 1, wherein the at least one fibrous web layer further comprises an additional layer on a technical front or a technical back.

14. The stitch-bonded fabric of claim 1, wherein the at least one fibrous web layer is further stitch-bonded with a second yarn forming protective underlaps of laid-in or stitched-in stitches.

15. A method for dimensionally stabilizing the stitch-bonded fabric in accordance with claim 1 comprising the steps of a. stitch-bonding a fibrous web layer with heat settable yarns following pattern of linear stitches along a machine direction (MD) to form the stitch-bonded fabric;

b. tightening the stitches to maintain fibers from the fibrous web within the stitches by applying heat to the stitch-bonding yarns, while planarly restraining the stitch-bonded fabric, wherein a density of fibers and yarn enclosed within the stitches is above about 0.10 g/$cm^3$ and below about 5.0 g/$cm^3$;

c. optionally shrinking or stretching the stitch-bonded fabric in step b.

16. The method of claim 15, wherein the tightening step (b) comprises heating the stitch-bonded fabric to a temperature range from about 120° C. to about 250° C.

17. The method of claim 15, wherein the tightening step (b) comprises embossing the stitch-bonded fabric.

18. The method of claim 15, wherein when step (c) occurs it comprises gathering the stitch-bonded fabric at least about 10% by allowing the heat settable yarns to shrink.

19. The method of claim 18, wherein step (c) comprises stretching the stitch-bonded fabric at least about 10%.

20. The method of claim 18, wherein the gathering is controlled by adjusting a heat treating temperature or by controlling the length of the stitch-bonded fabric and a distance between MD restraints.

21. The method of claim 17, wherein the embossing step comprising pressing a pattern having a depth of up to half of a thickness of the stitch-bonded fabric at a temperature above about 120° C. and below about 250° C.

* * * * *